US005093063A

United States Patent [19]

Watanabe et al.

[11] Patent Number: 5,093,063

[45] Date of Patent: Mar. 3, 1992

[54] METHOD OF PRODUCING POLYVINYL ALCOHOL FIBERS

[75] Inventors: Masaharu Watanabe; Kenichi Tanimoto; Kazutaka Kooda; Naohiko Nagata; Keiichi Wakayama; Tsunetoshi Matsuda, all of Kyoto, Japan

[73] Assignee: Unitika Ltd., Hyogo, Japan

[21] Appl. No.: 446,732

[22] Filed: Dec. 6, 1989

Related U.S. Application Data

[62] Division of Ser. No. 138,109, Dec. 28, 1987, Pat. No. 4,971,861.

[30] Foreign Application Priority Data

Dec. 27, 1986 [JP] Japan ..... 61-312602

[51] Int. Cl.[5] ..... D01F 6/14

[52] U.S. Cl. ..... 264/185; 264/205; 264/210.7; 264/210.8; 264/211.15; 264/211.17

[58] Field of Search ..... 264/185, 210.7, 205, 264/210.8, 211.15, 211.17

[56] References Cited

U.S. PATENT DOCUMENTS

| | | | |
|---|---|---|---|
| 3,751,547 | 6/1971 | Kawakami et al. | 264/185 |
| 3,852,402 | 12/1974 | Tanaka et al. | 264/185 |
| 4,440,711 | 4/1984 | Kwon et al. | 264/185 |
| 4,603,083 | 7/1986 | Tanaka et al. | 264/210.8 |

FOREIGN PATENT DOCUMENTS

| | | | |
|---|---|---|---|
| 2132055 | 5/1972 | Fed. Rep. of Germany | 264/185 |
| 457012 | 10/1970 | Japan | 264/185 |

*Primary Examiner*—Hubert C. Lorin

*Attorney, Agent, or Firm*—Sughrue, Mion, Zinn, Macpeak & Seas

[57] ABSTRACT

A high tenacity, high initial modulus polyvinyl alcohol fiber is produced by:

(1) dissolving polyvinyl alcohol with a degree of polymerization of not less than 1,500 in a solvent capable of giving a 5 wt % polyvinyl alcohol solution and the solvent is further characterized in that the nuclear magnetic resonance spectrum measured at 50° C. after storage of the solution at 50° C. for 96 hours following preparation thereof is substantially identical with that measured at 50° C. immediately after preparation thereof, with peaks for the three kinds of hydroxyl groups of polyvinyl alcohol being clearly distinguishable in each nuclear magnetic resonance spectrum, (ii) forming filaments by spinning the spinning solution under conditions which satisfy the requirements $$Ds \leqq 5.0$$

wherein Ds is the spinning stretch ratio defined as the ratio ($V_2/V_1$) of the take off speed ($V_2$) to the first take off roller speed ($V_1$), (iii) subjecting the filaments thus-formed to multistage stretching in at least two stages either continuously with step (ii) or after temporarily winding up the filaments, wherein at least one stretching stage in the multistage stretching is conducted at a temperature of not lower than 200° C. until the total stretch ratio amounts to not less than 15.

7 Claims, 2 Drawing Sheets

METHOD OF PRODUCING POLYVINYL ALCOHOL FIBERS

This is a divisional of application Ser. No. 07/138,109 filed Dec. 28, 1987, now U.S. Pat. No. 4,971,861.

FIELD OF THE INVENTION

The present invention relates to a polyvinyl alcohol (hereinafter abbreviated as "PVA") fiber and a method of producing the same. More particularly, it relates to a PVA fiber having a high tenacity, a high initial modulus of elasticity and showing a high level of crystalline heat of fusion, and a method of producing the same with good manufacturability.

BACKGROUND OF THE INVENTION

It has recently become possible to manufacture a high tenacity, high initial modulus fiber having a tenacity not less than 20 g/d and an initial modulus of elasticity not less than 500 g/d by the so-called liquid crystal spinning technique, wherein a polymer having a rigid molecular chain, for example, polyparaphenylene terephthalamide (hereinafter referred to briefly as PPTA) is dissolved in a suitable solvent, such as sulfuric acid, to a concentration at which the resulting solution shows the properties of a liquid crystal, and this solution is extruded through a spinneret. Such methods of manufacture of PPTA fibers are already in the stage of commercial implementation. However, such fibers have the disadvantage that in material cost as well as in production cost, they are by far more costly than ordinary fibers.

Meanwhile, the technique of producing a high tenacity, high initial modulus fiber from a flexible high molecular polymer has also been developed and is gathering much attention. This technique is known as the gel spinning method, by which polyethylene fibers having a tenacity at least about twice that of PPTA fiber and an initial elastic modulus approaching to its ultimate have been produced However, these fibers have the drawback of insufficient heat resistance because of their low melting properties.

Among the universal types of fibers, PVA fiber is excellent in tenacity and initial modulus of elasticity and, even in heat resistance, superior to polyethylene fiber. Therefore, it could be expected that if a technique were developed to produce a PVA fiber comparable to a PPTA fiber in tenacity and initial modulus of elasticity, this would represent a major contribution to this art, particularly in terms of reduced cost of manufacture and would lead to an expansion of uses.

Heretofore, various approaches have been explored to improve the tenacity and initial modulus of PVA fiber. For example, a method using a superhigh polymerization degree PVA having a molecular weight in excess of 500,000 is proposed in U.S. Pat. No. 4,440,711. However, this approach has the drawback that such a superhigh polymerization degree PVA is hardly available from commercial sources. Moreover, a PVA having such a superhigh degree of polymerization is only sparingly soluble in solvents and since solutions thereof are so high in viscosity, they are poor in spinnability. Therefore, it is inevitable to use low solution concentrations and this detracts from manufacturability.

In U.S. Pat. No. 4,603,083, it is disclosed that a PVA fiber having a tenacity of 19.6 g/d and an initial elastic modulus of 445 g/d could be manufactured by dissolving a high molecular weight PVA having a degree of polymerization of 4,000 in dimethyl sulfoxide (DMSO) to prepare a spinning dope and subjecting the resulting solution to dry-wet spinning. However, verification experiments made by the present inventors revealed that when the spinning dope is prepared using DMSO as a solvent, the stability of the dope is poor and it was difficult to manufacture a highly stretchable filament stably and continuously. Moreover, the crystalline heat of fusion of the fiber obtainable by drawing such filaments is as low as about 20 cal/g.

Japanese Patent Application (OPI) Nos. 108711/86 and 108712/86 (the term "OPI" as used herein refers to a "published unexamined Japanese Patent Application") propose the technique of extruding a spinning solution of a PVA having a polymerization degree of at least 1,500 in a nonvolatile solvent, such as ethylene glycol, glycerin or the like, in a coagulation solvent immiscible with the spinning solution, such as decalin, trichloroethylene or the like, by the wet or dry-wet spinning method. However, in these processes, the spinning speed is 5 m/min. at best and the required extraction of the nonvolatile solvent is so time-consuming that the technique cannot be successfully implemented on a commercial scale. Furthermore, this technique fails to accomplish an improvement in crystalline heat of fusion in any substantial degree, although it does improve the tenacity and initial elastic modulus of the fiber.

In the spinning processes disclosed in Japanese Patent Application (OPI) No. 85013/87, a mixture of water and DMSO, with addition of boric acid, is used as a solvent for PVA, but neither of the specifications includes references to the spinning stretch ratio which constitutes a feature of the present invention.

The method proposed in Japanese Patent Application (OPI) No. 90308/87, which comprises preparing a spinning dope by dissolving a PVA having a weight average molecular weight of $1.15\times10^5$ in DMSO or water and extruding the resulting dope in methanol, is analogous to the method described in U.S. Pat. No. 4,603,083 referred to hereinbefore and, of course, has the same drawbacks.

While a variety of methods have been proposed for the manufacture of a high tenacity, high initial modulus PVA fiber as mentioned above, the spinning method using a PVA having a superhigh degree of polymerization is disadvantageous in that such a polymer is not readily available on the market and is expensive.

The dry-wet spinning method using DMSO as a solvent for PVA does not assure the stability of the spinning dope and hence fails to permit the continuous stable production of highly stretchable filaments. Moreover, the PVA fiber obtainable by drawing such filaments is low in crystalline heat of fusion On the other hand, the wet or dry-wet spinning method comprising the extrusion of a solution of PVA in glycerin into a solvent such as decalin necessitates a low spinning speed which detracts from the commercial implementation of the method.

SUMMARY OF THE INVENTION

Therefore, it is an object of the present invention to provide a high tenacity, high initial modulus PVA fiber having a tenacity as high as at least 17 g/d, an initial modulus of elasticity as high as 400 g/d and, further, a high crystalline heat of fusion as high as at least 29 cal/g as determined by differential scanning calorimetry (hereinafter referred to briefly as DSC) which is described hereinafter. Another object is to provide a method by which such a high tenacity, high initial modulus fiber can be manufactured with efficiency and high manufacturability from a PVA having a degree of polymerization within the commercially available range.

Intensive investigations made by the present inventors in an attempt to achieve the above objects using PVA species having a commercially available degree of polymerization have now led to completion of the present invention.

The present invention provides a high tenacity, high initial modulus PVA fiber showing a high level of crystalline heat of fusion, which is characterized in that the fiber is made of PVA with a degree of polymerization of not less than 1,500 and has a tenacity of not less than 17 g/d, an initial modulus of elasticity of not less than 400 g/d and, further, a heat of fusion of crystals of not less than 29 cal/g as well as a method of producing such high tenacity, high initial modulus PVA fiber showing a high level of crystalline heat of fusion by subjecting a spinning solution prepared by dissolving a PVA species having a degree of polymerization of not less than 1,500 in a solvent to dry-wet spinning and stretching the thus-obtained unstretched filaments, and a method of producing the polyvinyl alcohol fiber comprising:

(i) dissolving polyvinyl alcohol with a degree of polymerization of not less than 1,500 in a solvent capable of giving a 5 wt % PVA solution for which the nuclear magnetic resonance spectrum (hereinafter referred to as "NMR waveform") measured at 50° C. after storage at 50° C. for 96 hours following preparation of the solution is substantially identical with that measured at 50° C. immediately after preparation of the solution, with peaks for the three kinds of hydroxyl groups of PVA being clearly distinguishable in each NMR waveform, (ii) forming filaments by spinning the spinning solution under conditions which satisfy the requirement $$Ds \leqq 5.0$$

where Ds is the spinning stretch ratio defined as the ratio ($V_2/V_1$) of the take off speed ($V_2$) to the first take off roller speed ($V_1$), (iii) subjecting the filaments thus-formed to multistage stretching in at least two stages either continuously with step (ii) or after temporarily winding up the filaments, wherein at least one stretching stage in the multistage stretching is conducted at a temperature of not lower than 200° C., until the total stretch ratio amounts to not less than 15.

BRIEF DESCRIPTION OF THE DRAWINGS

In FIGS. 1 and 2, peak 1 indicates isotacticity, peak 2 heterotacticity and peak 3 syndiotacticity.

DETAILED DESCRIPTION OF THE INVENTION

Figure 1:
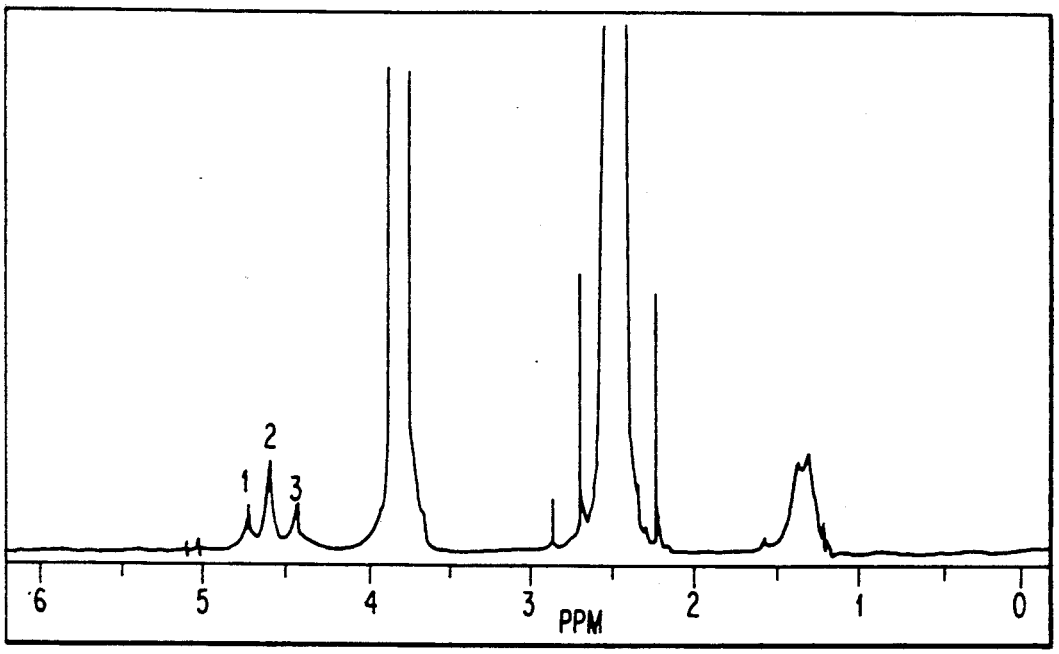
FIG. 1 shows an NMR waveform for a 5 wt % PVA solution prepared by using a solvent suited for the practice of the present invention as measured immediately after preparation of the solution.

To attain the physical properties desired of the product fiber, the raw material PVA to be used in accordance with the present invention has a degree of polymerization (monomers per molecule) of not less than 1,500, preferably not less than 3,000, more preferably not less than 4,500, most preferably not less than 6,000. To reduce the material cost and process cost, however, the degree of polymerization should preferably be not more than 10,000. The degree of saponification of PVA should preferably be not less than 99%.

For achieving the above objects of the present invention, it is important that the solvent used in preparing the spinning solution by dissolving PVA therein is capable of giving a 5 wt % PVA solution, and for which the NMR waveform measured at 50° C. after storage at 50° C. for 96 hours following preparation thereof is substantially identical with the NMR waveform measured at 50° C. immediately after preparation of the 5% solution, with peaks for the three kinds of hydroxyl groups of PVA being clearly distinguishable in each waveform.

The peak for a specific hydroxyl group of PVA, when measured on an NMR measuring apparatus with a resolution of about 100 MHz, is observed at one of three different chemical shift positions (hereinafter briefly referred to as "shift positions") separately depending on whether the hydroxyl group is syndiotactic, heterotactic or isotactic relative to the hydroxyl groups on both sides thereof, as described, for example, in T. Moritani, I. Kuruma, K. Shibatani, Y. Fujiwara, *Macromolecules*, published by American Chemical Society, Vol. 5 (No. 5), pp. 577-580 (1972). When substantial identity in NMR waveform in the present invention is mentioned herein, it is meant that comparison of two NMR waveforms does not reveal a difference by 0.1 ppm or more in any of the three shift positions.

When it is mentioned herein that the peaks for the three kinds of hydroxyl groups of PVA are clearly distinguishable in NMR waveform, it is meant that the peaks ascribable to the above-mentioned three kinds of hydroxyl groups may be observed separately so that the shift positions and half value widths can be determined with ease, without masking the peaks by peaks due to the solvent and/or additives and without disappearance of any of the various peaks.

Specifically, NMR waveform measurement can be performed under the following conditions:

| | |
|---|---|
| Apparatus: | Varian VXR 300 |
| Resonance frequency: | 300 MHz |
| Temperature: | 50° C. |
| Pulse width: | 2.0 μsec |
| Integration time: | 2.5 sec |
| Number of revolutions of sample: | 20 rpm |
| Standard sample: | Tetramethylsilane (0 ppm) |

When the NMR waveform for a 5% PVA solution obtained with a certain solvent as measured under the above conditions after 96 hours of storage at 50° C. is not substantially identical with the NMR waveform measured immediately after preparation of the 5% solution or when the NMR waveform measured after 96 hours of storage is not substantially identical with the NMR waveform measured immediately after preparation of the solution, although the NMR waveform measured after 48 hours of storage at 50° C. is substantially identical with that measured immediately after preparation of the solution (in other words, when the solution undergoes the so-called phenomenon of aging), the fiber obtained by spinning a spinning solution prepared by using these solvents shows a crystalline heat of fusion of at most 25 cal/g, although it has a high tenacity and a high initial modulus of elasticity. Furthermore, such spinning solution is poor in stability. Accordingly, such solvent is not suited for the purposes of the invention, namely for the efficient production of high tenacity, high initial modulus PVA fibers showing a high level of crystalline heat of fusion.

On the other hand, fibers obtained by using a solvent which gives a solution showing an NMR waveform with the above-mentioned peaks being not clearly distinguishable even when the solution does not undergo the so-called aging phenomenon have a tensile strength as low as 15 g/d or less and an initial modulus of at most 300 g/d, although they have a fairly high level of crystalline heat of fusion (27 cal/g or so). Consequently, it is difficult to obtain high tenacity, high initial modulus PVA fibers showing a high level of crystalline heat of fusion using such a solvent.

As the solvent with which the above-mentioned objects of the present invention can be accomplished, there may be mentioned mixed solvents composed of (a) an organic solvent such as DMSO or DMF (dimethylformamide) and (b) water or an aqueous solution of an inorganic salt such as calcium chloride, lithium chloride, etc. Among them, mixed solvents composed of water and DMSO are particularly preferred.

In the case of water-DMSO mixed solvents, the most preferred mixing ratio between water and DMSO is 27.7:72.3 by weight while any mixing ratio within the range of 10:90 to 45:55 can be employed without any substantial difficulties. Within the water-DMSO mixing ratio range of 0:100 to 10:90 by weight (exclusive of the ratio 10:90), however, the effect of the mixture as mixed solvent is not so good because it allows the so-called aging of the solution and the stability of the spinning solution is thus reduced. In addition, the filaments obtained unfavorably tend to have reduced stretchability. Within the water-DMSO mixing ratio of 45:55 to 100:0 by weight (exclusive of the ratio 45:55), the peaks for the three kinds of hydroxyl groups of PVA are masked in the peaks due to water, which is a constituent of the mixed solvent, so that they cannot be observed separately and distinguishably. The filaments have reduced stretchability and, in addition, the tenacity and initial modulus, too, unfavorably tend to decrease.

In the practice of the present invention, the above solvent may contain a heat stabilizer for PVA, a pigment, a crosslinking agent, and other additives, when appropriate.

When the degree of polymerization of PVA is about 1,500 to 10,000 and the spinning temperature is about 40° C. to about 120° C., the PVA concentration in the spinning solution should preferably be within the range of 2 to 35 wt %. When the concentration is less than 2 wt %, the spinnability will be low whereas, when the concentration is more than 35 wt %, the spinning solution has an increased viscosity and reduced homogeneity and, at the same time, the stretchability of the filaments unfavorably tends to decrease.

In accordance with the present invention, a spinning solution prepared by dissolving PVA in the above-mentioned solvent is extruded through a spinneret into a coagulation bath to form filaments referred to through the specification as filaments by the dry-wet spinning method known as described, for example, in U.S. Pat. No. 4,603,083, etc. In this method, the first take off roller speed ($V_1$) and the take off speed ($V_2$) have to be set in association with each other so that the spinning stretch ratio (Ds) defined as the ratio $V_2/V_1$ can be within the range $Ds \leqq 5.0$, preferably $Ds \leqq 4.0$, more preferably $Ds \leqq 3.0$. If the spinning stretch ratio is greater than 5.0, the macromolecule chains constituting the filaments are excessively oriented in the fiber axis direction and/or the filament structures are destroyed, so that the stretchability is markedly reduced and the fiber tenacity and crystalline heat of fusion also tend to decrease. In the practice of the present invention, the spinning stretch ratio value can be selected optionally provided that it should be not greater than 5.0. From the practical viewpoint, a value of greater than 0 should be selected and, for increasing the manufacturability and decreasing the variation in fineness among filaments, a value of not less than 0.3 is preferably selected.

Usable as the coagulation bath are, for example, alcohols such as methanol, ethanol, propanol, isopropanol and butanol, and mixed solvents composed of such an alcohol and the solvent for PVA. Among alcohols, methanol is particularly suitable.

In accordance with the present invention, the filaments formed in the above-mentioned coagulation bath are submitted to the step of stretching either continuously with the filament forming step or after winding up of the filaments produced in step (ii). In practicing the present invention, the filaments may appropriately be subjected to steps of drying, oiling and/or other necessary treatments during the step (ii) of forming them or prior to submission thereof to the step of stretching in step (iii). In the case where stretching is included in such a treatment step, the stretch ratio in these steps should be included in the above-mentioned step (ii) spinning stretch ratio ($Ds \leqq 5.0$) if the treatment step is conducted during the step of forming filaments, or if the treatment step is conducted after the spinning and taking off step, the stretch value should be included in the other stretch ratio.

Various techniques of stretching may be employed in the practice of the present invention; for example, the technique of stretching which comprises stretching the PVA filaments while bringing them into contact with a heating body such as a heating plate, the technique comprising stretching them in a hot air bath (e.g., in a heating oven), the technique comprising stretching them in a heat medium, and the technique comprising stretching them by dielectric heating. In accordance with the present invention, multistage stretching is conducted in two or more stages by using such a technique and at least one of the multistage stretching stages is carried out at a temperature of not lower than 200° C., preferably not lower than 210° C., more preferably not lower than 220° C. It is preferable in the practice of the present invention to perform the final stage stretching at a temperature of not lower than 200° C.

In the multistage stretching process, moistening, oiling and/or the like treatment may be conducted between the nth stretching stage and the $(n+1)$th stretching stage (n being an integer of 1 or more).

For producing a high tenacity, high initial modulus PVA fiber with a high level of crystalline heat of fusion, it is necessary for the total stretch ratio inclusive of the spinning stretch ratio to amount to at least 15, preferably not less than 20, more preferably not less than 25. The term "total stretch ratio" as used herein is obtained by multiplying the above-mentioned spinning stretch ratio by the stretch ratios relative to all stretching stages subsequent to the spinning and take off stage. In the total stretch ratio, the other stretch ratio may be also included.

In accordance with the present invention, PVA fibers having a tenacity of not less than 17 g/d, preferably not less than 19 g/d, more preferably not less than 21 g/d, most preferably not less than 23 g/d, an initial modulus of elasticity of not less than 400 g/d, preferably not less than 450 g/d, more preferably not less than 500 g/d, most preferably not less than 550 g/d, and a crystalline heat of fusion of not less than 29 cal/g, preferably not less than 30 cal/g, more preferably not less than 31 cal/g, most preferably not less than 32 cal/g, can be produced at low cost and with good manufacturability by using commercially available PVA species which have a degree of polymerization of not less than 1,500, preferably not less than 3,000, more preferably not less than 4,500, most preferably not less than 6,000, but preferably not more than 10,000.

The success achieved by the present inventors in obtaining PVA fibers having excellent fiber characteristics, namely a tenacity of at least 17 g/d and an initial modulus of at least 400 g/d, and, further, a high crystalline heat of fusion of not less than 29 cal/g as determined from the area of the endothermic peak appearing at temperatures of not lower than 190° C. in accordance with a DSC method is attributed to the discovery that when a solvent capable of giving a PVA solution which will not undergo the so-called aging relative to the NMR waveform measured for the solution, with peaks for the three kinds of hydroxyl groups of PVA being observable and clearly distinguishable, is used as the solvent for PVA, the stability of the spinning solution is improved and the stretchability of the filaments obtained therefrom is increased and that the stretchability is further improved and the crystalline heat of fusion is also improved when the spinning solution prepared by using such a solvent is spun in a manner such that the spinning stretch ratio is not more than 5 and the resultant filaments are stretched in the manner of multistage stretching in two or more stages, with at least one stage of stretching being conducted at a temperature of not lower than 200° C. The objects of the invention have thus been accomplished by integration and coordination of the above findings.

In accordance with the present invention, it is also possible to produce PVA fibers having an apparent crystal size $(L(101)+(10\bar{1}))$ of not smaller than 65 Å, preferably not smaller than 67 Å, as calculated by wide angle X-ray diffraction but showing no long period patterns of the small angle X-ray scattering. Furthermore, it is possible to produce, in accordance with the present invention, PVA fibers showing a birefringence of not less than $60\times10^{-3}$, preferably not less than $65\times10^{-3}$, more preferably not less than $69\times10^{-3}$.

The reason why highly stretchable PVA filaments can be obtained in accordance with the present invention has not been fully explained as yet. Presumably, however, a reason may be that the spinning solution obtained by using an appropriate solvent according to the present invention is stable against the so-called aging but is unstable to temperature changes or to PVA concentration changes in the spinning solution. Thus, it is supposed that while in the case of dry-wet spinning, the coagulation of PVA and extraction of the solvent are started in the coagulation bath after extrusion of the spinning solution through the spinneret, PVA coagulation takes place following minute liquid-liquid phase separation via a state of a kind of supersaturation as a result of rapid cooling of the spinning solution extruded into the coagulation bath and the subsequent extraction of the solvent and that, as a result, the filaments formed have a structure including a large number of minute pores in the PVA phase and this enables high ratio stretching.

The following examples are further illustrative of the present invention.

In the examples, the degree of polymerization of PVA, fiber tenacity, initial modulus and crystalline heat of fusion were measured in the following manner:

Degree of Polymerization

The degree of polymerization was calculated from $[\eta]$ of the aqueous solution of PVA as measured by the method of testing PVA as described in JIS-K 6726-1977 as follows:

$$\log\overline{P}_A = 1.613 \log \frac{[\eta] \times 10^4}{8.29}$$

where $\overline{P}_A$ is the average degree of polymerization and $[\eta]$ is the intrinsic viscosity.

Tenacity and Initial Modulus

Apparatus: Tensilon UTM-4 tensile tester (manufactured by Tokyo-Baldwin Co., Ltd.)
Specimen length: 20 cm
Pulling speed: 20 cm/minute
Measurement atmosphere: 20° C., 65% RH
Initial modulus: Determined from the gradient of the strength-elongation curve at the origin.

Crystalline Heat of Fusion

Apparatus: DSC-2C (manufactured by Perkin Elmer)
Sample size: 3 mg
Tension on sample: None (tensionless)
Cell: Normal pressure cell
Rate of temperature rise: 20° C./minute
Measurement atmosphere: Nitrogen atmosphere
Correction with regard to temperature and heat of fusion: For this purpose, 99.99% pure indium was used.

PVA Solutions

A 5 wt % PVA solution was prepared by dissolving PVA having a degree of polymerization of 4,800 in a mixed solvent composed of water and DMSO in a mixing ratio of 20:80. The solution was subjected to NMR waveform measurement at a temperature of 50° C. immediately after preparation thereof. The NMR waveform thus obtained is shown in FIG. 1.

Figure 2:
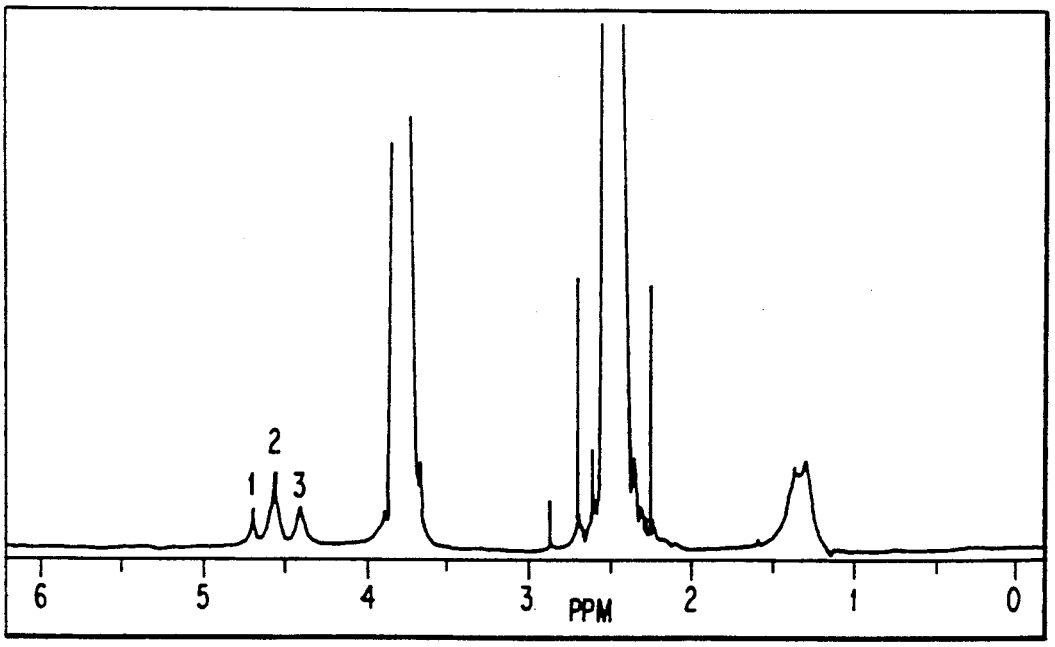
FIG. 2 shows an NMR waveform for the same solution as measured after 96 hours of storage at 50° C. following preparation of the solution.

The NMR waveform measured with the same solution after 96 hours of storage at 50° C. is shown in FIG. 2.

Figure 3:
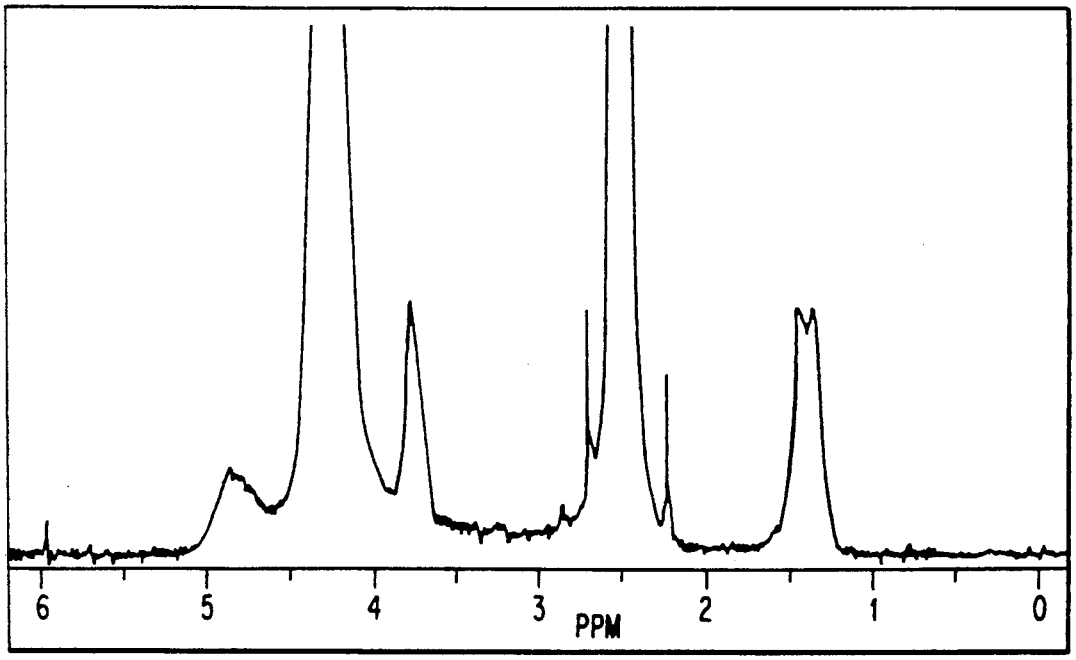
FIG. 3 shows an NMR waveform for a 5 wt % PVA solution prepared by using a conventional solvent.

For comparison, the NMR waveform measured with a solution prepared in the same manner using a 60:40 (by weight) mixture of water and DMSO as the solvent is shown in FIG. 3.

Comparison between FIG. 1 and FIG. 2 reveals that both the NMR waveforms are substantially identical (deviations relative to peaks of hydroxyl groups of PVA being at most 0.034 ppm), hence it is evident that there was no occurrence of the so-called aging.

Comparison between FIG. 1 and FIG. 3 reveals that while peaks for the three kinds of hydroxyl groups of PVA are observable in FIG. 1 distinctly and separately at the shift positions of 4.3, 4.48 and 4.52 ppm, the corresponding peaks cannot be observed separately in FIG. 3 as a result of masking thereof by peaks due to the solvent-constituting water.

Furthermore, solutions were prepared using 100% DMSO (i.e., 0:100 mixed solvent) and 100% water (i.e., 100:0 mixed solvent) in the same manner and submitted to NMR waveform measurement. In the case of 100% DMSO, the peaks of the three kinds of hydroxyl groups of PVA were observed separately when the measurement was carried out immediately after preparation of the solution, but these peaks had disappeared when measured after the lapse of 48 hours and of 96 hours (they were indistinguishable from the baseline). In the case of 100% water, the three peaks due to PVA were included in peaks due to water even immediately after preparation of the solution, hence the three peaks in question could not be observed separately.

EXAMPLE 1 AND COMPARATIVE EXAMPLES 1 TO 3

Four spinning solutions each having a 12 wt % PVA concentration were prepared by dissolving PVA with a degree of polymerization of 4,800 in four kinds of solvents, namely a 20:80 (by weight) mixture of water and DMSO, a 60:40 (by weight) mixture of water and DMSO, 100% DMSO (0:100), and 100% water (100:0). These spinning solutions were extruded through a spinneret heated at 80° C. into a 15:85 (by weight) mixture of DMSO and methanol except for the case of 100% water solvent where dry-wet spinning was carried out using an aqueous solution of sodium sulfate with a concentration of 350 g/liter. In the case of 100% water solvent, the aqueous sodium sulfate solution (350 g/liter) was used, because the filaments were hardly taken off due to the insufficient coagulation in the 15:85 (by weight) mixture of DMSO and methanol. The thus-formed PVA filaments were thoroughly freed of the solvent by extraction with methanol and then dried. Thus were obtained filaments having a fineness of 5,300 denier/100 filaments.

These filaments were subjected to two-stage hot stretching in a hot air oven. The stretch ratios employed are shown below in Table 1. Each of the stretch ratios corresponded to 95% of the respective maximum stretch ratios. The term "maximum stretch ratio" as used herein means a stretch ratio at which about 5% of all the filaments are broken.

The stretching conditions and the results of measurements of the stretched filaments obtained in the above manner for quality characteristics and crystalline heat of fusion are shown in Table 1.

TABLE 1

| Item | Comparative Example 1 | Example 1 | Comparative Example 2 | Comparative Example 3 |
|---|---|---|---|---|
| water/DMSO | 0:100 DMSO 100% | 20:80 | 60:40 | 100:0 Water 100% |
| Spinning stretch ratio | 2.0 | 2.0 | 2.0 | 2.0 |
| First stage stretching temperature (°C.) | 160 | 160 | 160 | 160 |
| First stage stretch ratio | 8.0 | 9.5 | 8.0 | 6.5 |
| Second stage stretching temperature (°C.) | 220 | 220 | 220 | 220 |
| Second stage stretch ratio | 1.15 | 1.40 | 1.21 | 1.09 |
| Total stretch ratio | 18.4 | 26.6 | 19.4 | 14.2 |
| Strength (g/d) | 17.8 | 23.7 | 14.8 | 12.5 |
| Initial modulus (g/d) | 414 | 545 | 294 | 227 |
| Crystalline heat of fusion (cal/g) | 23.2 | 29.8 | 27.2 | 25.3 |

The stretched filaments obtained in Example 1 were measured for apparent crystal size ($L(101)+(10\bar{1})$) and long period by wide angle X-ray diffraction and by small angle X-ray scattering, respectively, under the conditions mentioned below. The apparent crystal size was thus found to be 67 Å, whereas no long period patterns were found. The birefringence determined by the conventional method was as high as $69\times10^{-3}$.

The apparent crystal size measurement by wide angle X-ray diffraction was performed under the following conditions:

| | |
|---|---|
| Apparatus: | Model RAD-rB (manufactured by Rigaku Denki) |
| X-ray: | CuKα (Ni filter used) |
| Output: | 50 kV, 200 mA |
| Sample holder: | Type FS-3 fiber sample holder |
| Goniometer: | Wide angle goniometer PMG-RA |
| Slits: | First slit: 1 mm ϕ pinhole slit<br>Beam-receiving slit: 1° × 1° |
| Detector: | Scintillation counter |

The apparent crystal size $L(101)+(10\bar{1})$ was calculated from the half width of the peak for the Miller index $(101)+(10\bar{1})$ as obtained by the above wide angle X-ray diffraction, according to the equation of Scherrer:

$$L(101)+(10\bar{1})=K\lambda/\beta_o\cos\theta$$

$$\beta_o^2=\beta_e^2-\beta_i^2$$

where $\beta_e$ is the apparent half width, $\beta_i$ is 0.06,

K is Scherrer's constant (0.9),

λ is the wavelength, and

θ is the Bragg angle.

The long period determination by small angle X-ray scattering was conducted in the conventional manner using the same X-ray apparatus and setting as used in the above-mentioned wide angle X-ray diffraction.

EXAMPLES 2 TO 7 AND COMPARATIVE EXAMPLES 4 AND 5

Spinning solutions having a 15 wt % PVA concentration were prepared by dissolving PVA species having degrees of polymerization of 1,300, 2,300, 3,500, 4,800 and 7,000, respectively, in a 20:80 (by weight) mixture of water and DMSO at 110° C. except for the case of the degree of polymerization of 7,000 where the PVA concentration was 11 wt %. These spinning solutions were subjected to dry-wet spinning. Thus, each solution was extruded from a spinneret maintained at 80° C. into a 10:90 (by weight) mixture of DMSO and methanol. The PVA filaments thus-formed were then thoroughly deprived of water and DMSO by extraction with methanol, and dried. The thus-obtained filaments having a fineness of 6,000 denier/100 filaments were hot-stretched in two stages in the stretch ratios shown in Table 2. The stretch ratios were equal to 90% of the respective maximum stretch ratios.

For comparison, filaments were produced using the spinning solution of Example 4 and a spinning stretch ratio of 6.0, followed by hot stretching in the same manner.

TABLE 2

| Item | Comparative Example 4 | Example 2 | Example 3 | Example 4 | Example 5 | Comparative Example 5 | Example 6 | Example 7 |
|---|---|---|---|---|---|---|---|---|
| Degree of polymerization of PVA | 1,300 | 2,300 | 3,500 | 4,800 | 7,000 | 4,800 | 4,800 | 4,800 |
| Spinning stretch ratio | 2.0 | 2.0 | 2.0 | 2.0 | 2.0 | 6.0 | 4.0 | 4.9 |
| First stage stretching temperature (°C.) | 150 | 150 | 150 | 150 | 150 | 150 | 150 | 150 |
| First stage stretch ratio | 8.0 | 8.0 | 8.0 | 8.0 | 8.0 | 2.5 | 3.7 | 3.0 |
| Second stage stretching temperature (°C.) | 220 | 220 | 220 | 220 | 220 | 220 | 220 | 220 |
| Second stage stretch ratio | 1.05 | 1.15 | 1.34 | 1.51 | 2.02 | 1.05 | 1.25 | 1.15 |
| Hot stretch ratio | 8.4 | 9.2 | 10.7 | 12.1 | 16.2 | 2.6 | 4.6 | 3.5 |
| Total stretch ratio | 16.8 | 18.4 | 21.4 | 24.2 | 33.5 | 15.6 | 18.5 | 16.9 |
| Strength (g/d) | 13.5 | 17.3 | 19.5 | 21.4 | 30.2 | 11.6 | 18.7 | 17.5 |
| Initial modulus (g/d) | 320 | 411 | 435 | 493 | 620 | 339 | 431 | 410 |
| Crystalline heat of fusion (cal/g) | 28.5 | 29.2 | 30.3 | 31.5 | 34.6 | 28.4 | 30.2 | 29.7 |

The stretching conditions and the results of measurements of the stretched filaments obtained for quality characteristics and for crystalline heat of fusion are summarized in Table 2.

EXAMPLES 8 AND 9 AND COMPARATIVE EXAMPLES 6 TO 8

Stretched filaments were obtained by using the filaments of Example 4 and carrying out hot stretching in the stretch ratios shown in Table 3.

The stretching conditions and the results of measurements of the stretched filaments obtained for quality characteristics and crystalline heat of fusion are shown in Table 3.

TABLE 3

| Item | Comparative Example 6 | Comparative Example 7 | Comparative Example 8 | Example 8 | Example 9 |
|---|---|---|---|---|---|
| Degree of polymerization of PVA | 4,800 | 4,800 | 4,800 | 4,800 | 4,800 |
| Spinning stretch ratio | 2.0 | 2.0 | 2.0 | 2.0 | 2.0 |
| First stage stretching temperature (°C.) | 220 | 150 | 150 | 150 | 150 |
| First stage stretch ratio | 10.4 | 8.0 | 7.0 | 8.0 | 8.0 |
| Second stage stretching temperature (°C.) | — | 190 | 220 | 210 | 200 |
| Second stage stretch ratio | — | 1.25 | 1.05 | 1.43 | 1.33 |
| Hot stretch ratio | 10.4 | 10.0 | 7.4 | 11.4 | 10.6 |
| Total stretch ratio | 20.8 | 20.0 | 14.8 | 22.9 | 21.3 |
| Strength (g/d) | 14.7 | 14.6 | 13.7 | 20.1 | 19.8 |
| Initial modulus (g/d) | 366 | 358 | 305 | 458 | 459 |
| Crystalline heat of fusion (cal/g) | 27.5 | 27.2 | 25.5 | 30.9 | 30.5 |

As detailedly described hereinabove, the present invention has made it possible to produce high tenacity, high initial modulus PVA fibers comparable to PPTA fibers at low cost and with commercially employable techniques by using commercially available PVA species having a degree of polymerization of not less than 1,500, preferably not less than 3,000. Furthermore, the PVA fibers obtained by the method of the present invention show a high level of crystalline heat of fusion and, therefore, they have good heat stability and good resistance to hot water, so that they may be employed not only in those applications that are typical of PVA fibers, such as fishing net and rope manufacture and use as reinforcements for cement, plastic materials and so forth, but their employment can be extended to applications such as tire cords and as reinforcements for rubber in the manufacture of V belts, timing belts and so forth.

While the invention has been described in detail and with reference to specific embodiments thereof, it will be apparent to one skilled in the art that various changes and modifications can be made therein without departing from the spirit and scope thereof.

What is claimed is:

1. A method of producing high tenacity, high initial modulus, high crystalline fusion heat polyvinyl alcohol fibers having a tenacity of not less than 17 g/d and an initial modulus of elasticity of not less than 400 g/d and having a crystalline heat of fusion of not less than 29 cal/g comprising the steps of:

(i) dissolving polyvinyl alcohol having a degree of polymerization of 1500 to 10,000 in a solvent capable of giving a 5 weight % polyvinyl alcohol solution, wherein said solvent is a water/dimethyl sulfoxide mixed solvent having a ratio between water and dimethyl sulfoxide of from 10:90 to 45:55 by weight and wherein said solvent is further characterized in that the nuclear magnetic resonance spectrum measured at 50° C. for 96 hours following preparation thereof is substantially identical with that measured at 50° C. immediately after preparation thereof, with peaks for the three hydroxyl groups of polyvinyl alcohol being clearly distinguishable in each nuclear magnetic resonance spectrum;

(ii) forming filaments by dry-wet spinning the spinning solution under conditions which satisfy the requirement $$Ds \leqq 5.0$$

wherein Ds is the spinning stretch ratio defined as the ratio ($V_2/V_1$) of the take of speed ($V_2$) to the first take off roller speed ($V_1$); and (iii) subjecting the resulting filaments of step (ii) to multistage heat stretching in at least two stages either continuously with step (ii) or after temporarily winding up the filaments, wherein at least one heat-stretching stage in said multistage heat-stretching is conducted at a temperature of not lower than 200° C. until the total stretch ratio amounts to not less than 15.

2. The method of claim 1, wherein said polyvinyl alcohol has a degree of polymerization of not less than 3,000.

3. The method of claim 1, wherein the spinning solution has a polyvinyl alcohol concentration of 2 to 35 wt %.

4. The method of claim 1, wherein the total stretch ratio amounts to not less than 20.

5. The method of claim 1, wherein spinning in step (ii) is carried out in a manner such that the spinning stretch ratio (Ds) is not greater than 4.0, i.e., $Ds \leqq 4.0$.

6. The method of claim 1, wherein at least one heat-stretching stage is conducted at a temperature of not lower than 210° C.

7. The method of claim 1, wherein at least one heat-stretching stage is conducted at a temperature of not lower than 220° C.

* * * * *